US010634308B2

(12) United States Patent
Carnarius et al.

(10) Patent No.: US 10,634,308 B2
(45) Date of Patent: Apr. 28, 2020

(54) LIGHTING DEVICE FOR A MOTOR VEHICLE

(71) Applicant: VOLKSWAGEN AKTIENGESELLSCHAFT, Wolfsburg (DE)

(72) Inventors: Angelo Carnarius, Berlin (DE); Andreas Tikwe, Lehre (DE); Ralf Simanek, Gifhorn (DE)

(73) Assignee: Volkswagen Aktiengesellschaft, Wolfsburg (DE)

( * ) Notice: Subject to any disclaimer, the term of this patent is extended or adjusted under 35 U.S.C. 154(b) by 51 days.

(21) Appl. No.: 15/831,672

(22) Filed: Dec. 5, 2017

(65) Prior Publication Data

US 2018/0156412 A1 Jun. 7, 2018

(30) Foreign Application Priority Data

Dec. 5, 2016 (DE) ..... 10 2016 224 099

(51) Int. Cl.

| | |
|---|---|
| ***F21V 21/00*** | (2006.01) |
| ***F21S 45/33*** | (2018.01) |
| ***F21S 45/60*** | (2018.01) |
| ***F21S 45/43*** | (2018.01) |
| *F21V 29/67* | (2015.01) |
| *F21V 31/03* | (2006.01) |

(52) U.S. Cl.

CPC ..... *F21S 45/33* (2018.01); *F21S 45/43* (2018.01); *F21S 45/60* (2018.01); *F21V 29/67* (2015.01); *F21V 31/03* (2013.01)

(58) Field of Classification Search

CPC ..... B60Q 1/2696; F21S 45/00; F21S 45/10; F21S 45/30

USPC ..... 362/545, 546, 547

See application file for complete search history.

(56) References Cited

U.S. PATENT DOCUMENTS

| | | | | |
|---|---|---|---|---|
| 6,164,806 | A * | 12/2000 | Schmickl | F21S 48/335 362/294 |
| 6,371,635 | B2 | 4/2002 | Ott et al. | |
| 6,639,360 | B2 * | 10/2003 | Roberts | H01L 23/42 257/E23.087 |
| 8,746,937 | B2 | 6/2014 | Hong et al. | |
| 2007/0035957 | A1 * | 2/2007 | Albou | F21V 29/73 362/487 |

(Continued)

FOREIGN PATENT DOCUMENTS

| | | |
|---|---|---|
| CN | 102444849 A | 5/2012 |
| CN | 103175083 A | 6/2013 |

(Continued)

*Primary Examiner* — Daniel St Cyr

(74) *Attorney, Agent, or Firm* — Laurence A. Greenberg; Werner H. Stemer; Ralph E. Locher

(57) ABSTRACT

A lighting device for a motor vehicle has a ventilating device for ventilating the interior of the lighting device. The ventilating device has at least one separate component which is connected to a lower housing wall of the lighting device in the region of a ventilation opening in the housing wall, and through which component external air can pass into the interior. The component is embodied as an air-guiding element by which a slip stream can be selectively deflected from the outside onto at least one specific partial region of a lens of the lighting device. The ventilation and therefore the demisting of the lighting device is significantly improved.

13 Claims, 8 Drawing Sheets

(56) References Cited

U.S. PATENT DOCUMENTS

| | | | | |
|---|---|---|---|---|
| 2016/0377255 | A1* | 12/2016 | Schubert | F21S 45/37<br>362/547 |
| 2017/0015235 | A1* | 1/2017 | Puente | B60Q 1/0023 |

FOREIGN PATENT DOCUMENTS

| | | | |
|---|---|---|---|
| DE | 3138360 | C2 | 6/1985 |
| DE | 3004413 | C2 | 3/1989 |
| DE | 19524163 | A1 | 1/1997 |
| DE | 19813294 | C1 | 8/1999 |
| DE | 19963337 | A1 | 7/2001 |
| DE | 10135849 | A1 | 2/2003 |
| DE | 102009017728 | A1 | 10/2010 |
| DE | 102011084312 | A1 | 4/2012 |
| DE | 102015211906 | A1 | 12/2016 |
| EP | 2239163 | A1 | 10/2010 |
| FR | 2701756 | A1 | 8/1994 |
| FR | 2698055 | B1 | 2/1995 |
| FR | 3024764 | A1 | 2/2016 |
| GB | 2069120 | A | 8/1981 |

* cited by examiner

LIGHTING DEVICE FOR A MOTOR VEHICLE

CROSS-REFERENCE TO RELATED APPLICATION

This application claims the benefit, under 35 U.S.C. § 119, of German patent application DE 10 2016 224 099.4, filed Dec. 5, 2016; the prior application is herewith incorporated by reference in its entirety.

BACKGROUND OF THE INVENTION

Field of the Invention

The invention relates to a lighting device for a motor vehicle having means for ventilating the interior of said lighting device. The ventilating means include at least one separate component which is connected to a housing wall of the lighting device in the region of a ventilation opening in the housing wall. Air can pass through the component from the exterior into the interior.

In lighting devices there is frequently the problem that after the lighting device has been switched off and accordingly the air present in the interior of the lighting device has cooled, the moisture present in the air is precipitated as condensate on the cooled lens and mists up the lens. During subsequent re-activation of the lighting device, for example during a journey to work in the morning, structurally predefined ventilation through known ventilation openings is often not able to ventilate all the regions of the lens sufficiently and therefore carry away the moisture which has been precipitated on the lens. This of course gives rise to optical functional limitations of the lighting device.

Therefore, attempts have been made for a long time to improve the air circulation in lighting devices.

For example, German patent DE 30 04 413 C2 discloses a lighting device for a motor vehicle with the features as listed above in the introductory paragraph dealing with the field of the invention. In that lighting device, two air inlets which are embodied as spouts are formed in the lower housing wall. A vertically oriented duct which is provided on the outside of the housing is fluidically connected to the interior of the lighting device and has a chimney effect, with the result that air entering the spouts is moved and aspirated away through the interior to an opening of the duct.

German patent DE 198 13 294 C1 discloses a ventilation device on a motor vehicle headlight, which ventilation device is formed by a ventilation duct. The ventilation duct is integrally formed onto the edge of the lens or onto the housing of the motor vehicle headlight. Said ventilation duct extends essentially perpendicularly with respect to a light exit face of the lens, and at least one region of the outer wall of the ventilation duct is connected in a materially joined fashion to an edge region of the housing or of the lens.

German published patent application DE 195 24 163 A1 also discloses a lighting device for a motor vehicle having (passive) forced ventilation of the interior. An outflow opening for air is specifically provided in an upper part of a sealing profile which is arranged running around between the motor vehicle light and an installation opening provided in the vehicle bodywork. In addition, it is proposed to arrange an air inflow opening either in the region of a lower housing wall of the lighting device or in a lower part of the sealing profile.

French patent FR 2 701 756 B1 discloses a lighting device for a motor vehicle having active ventilation. In that context, a fan is arranged in the housing of the lighting device, in front of an air inlet opening which is on the rear of the housing and near to the floor. An air outlet opening is present in the upper region at the rear of the housing. A moisture sensor measures the humidity present near to the lens and actuates the fan when necessary in such a way that a circulation of air is brought about with an inflow which moves past the lens, from bottom to top.

A headlight for a motor vehicle having an active ventilation system in which a fan which is arranged outside the housing is used is also described in German published patent application DE 101 35 849 A1. The fan is connected to one or more air inlet openings of the housing via lines, wherein the air is conducted to a lower edge of the lens via one or more air-guiding ducts which are formed on the floor of the headlight. A gap, which extends over the entire width of the lens, is formed at the lower edge of the lens, by the air-guiding duct. The air which exits the gap moves along the lens from bottom to top, to an air-guiding duct which is formed in an upper housing wall, and said air is carried away to the outside in said air guiding duct.

The abovementioned prior art has in common the fact that the intention is to generate an air flow of this kind which moves essentially vertically from the bottom to the top along a lens.

However, it has become apparent that such a type of ventilation does not always bring about sufficient demisting. This occurs, in particular, when the interior of a lighting device has acute angles owing to additional components and/or decorative elements and therefore specific regions of the lens are not easily accessible to an air stream.

SUMMARY OF THE INVENTION

It is accordingly an object of the invention to provide a lighting device for a vehicle which overcomes the above-mentioned and other disadvantages of the heretofore-known devices and methods of this general type and which provides for a lighting device with a ventilation of its interior that is improved even further.

With the foregoing and other objects in view there is provided, in accordance with the invention, a lighting device for a motor vehicle, the lighting device comprising:

a housing with an interior and a housing wall, the housing wall having a ventilation opening formed therein;

a ventilation device for ventilating the interior of the lighting device, the ventilation device having at least one separate component connected to the housing wall in a vicinity of the ventilation opening, the separate component being configured to enable external air from outside to pass into the interior;

the component being an air-guiding element configured to selectively deflect a slip stream of air from the outside onto at least one specific partial region of the lens of the lighting device.

In other words, the invention is based on a lighting device for a motor vehicle having a ventilating device for ventilating the interior of the lighting device. The ventilating device, or ventilating means, comprise at least one separate component which is connected to a housing wall of the lighting device in the region of a ventilation opening in said housing wall. External air can pass into the interior of the lighting device through the separate component.

According to the invention it is proposed that the component be embodied as an air-directing element by which a slip stream can be selectively deflected from the outside onto at least one specific partial region of the lens of the lighting device.

In this way, even regions of a lens which are less accessible to an upward directed air flow, as described in the prior art, can also be effectively demisted. By means of the elements which are embodied as separate components and guide air, highly flexible adaptation to specifically present thermal conditions in the lighting device can be brought about cost-effectively.

According to a first development, the separate component has one air inlet opening and at least two air outlet openings by which the air stream entering the component is divided. As a result of the division of the air stream, a single ventilation opening in the lower housing wall of the ventilation device can be utilized better, since as a result a plurality of regions of the lens which are critical for demisting can be supplied with an air stream.

In order to be able to manufacture the component easily, it is also proposed that the component be composed of at least two parts.

According to another advantageous refinement of the inventive concept, the at least one separate component is arranged in the front region of the lower housing wall, near to the lens. In this way, the deflection path of the slip stream flowing into the separate component can be kept short and therefore the efficiency can be optimized.

Particularly effective support for any ventilation of the lighting device can be implemented by virtue of the fact that in the interior of said lighting device there is at least one fan by which an air flow can be generated. The fan is preferably arranged here in the rear region of the interior, that is to say near to a rear wall of the housing of the lighting device.

In such an embodiment, it has proven particularly advantageous to orient the fan in such a way that it can generate a vertical air flow at least in its immediate region. In this way, the flow which is generated by the at least one separate component and is directed to regions of the lens which are critical for demisting can be supplemented or assisted by a circulating flow in the interior of the lighting device.

In particular, the fan can be oriented in such a way that the vertical air flow generated by said fan is directed from top to bottom at least in its immediate region. As a result, a flow from bottom to top, and therefore a natural flow tendency of heated air is assisted at the lens.

However, it should also not be underestimated that with such an orientation of the fan in the x direction of the lighting device (that is to say in the longitudinal direction of the vehicle) there can be a considerable saving in terms of installation space, which usually has extremely tight dimensions.

However, it is alternatively also conceivable to orient the fan in such a way that it can generate a horizontal air flow which runs transversely with respect to a light emission direction or travel direction. As a result it also becomes possible to achieve a saving in installation space in said x direction. In addition, this provides the possibility of achieving good results with respect to improving the ventilation when using a plurality of light modules in a lighting device even with just a single active ventilation device (fan). The fan which is attached to a light module can therefore easily also supply a sufficient air flow to a passive cooling device (heat sink) which is assigned to the other light module.

Cooling of the lighting device can be made particularly effective if the fan is positioned in such a way that the air flow which is generated by it is guided directly through a heat sink.

Another improvement in the efficiency of the exchange of heat between the air and heat sink can be achieved by virtue of the fact that the heat sink has, in cross section, cooling fins which run in a meandering fashion and have clearance distances through which a generated air flow of the fan flows.

In addition, optimal utilization of the air flow generated by the fan can be achieved if the fan is attached to a mount from which three walls which are connected to one another in a materially joined fashion extend along the flow direction which can be generated and enclose the heat sink, at least for the most part.

The invention is also intended to place under protection a motor vehicle which has at least one lighting device according to the invention. The lighting device is preferably embodied here as a headlight.

Preferred exemplary embodiments of the invention are illustrated in the figures and will be explained in more detail in the following description with reference to the figures. As a result, further advantages of the invention also become clear. The same reference symbols relate to identical, comparable or functionally identical components, even in different figures. In this context, corresponding or comparable properties and advantages are achieved even if there is no repeated description or reference thereto.

Other features which are considered as characteristic for the invention are set forth in the appended claims.

Although the invention is illustrated and described herein as embodied in a lighting device for a motor vehicle, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
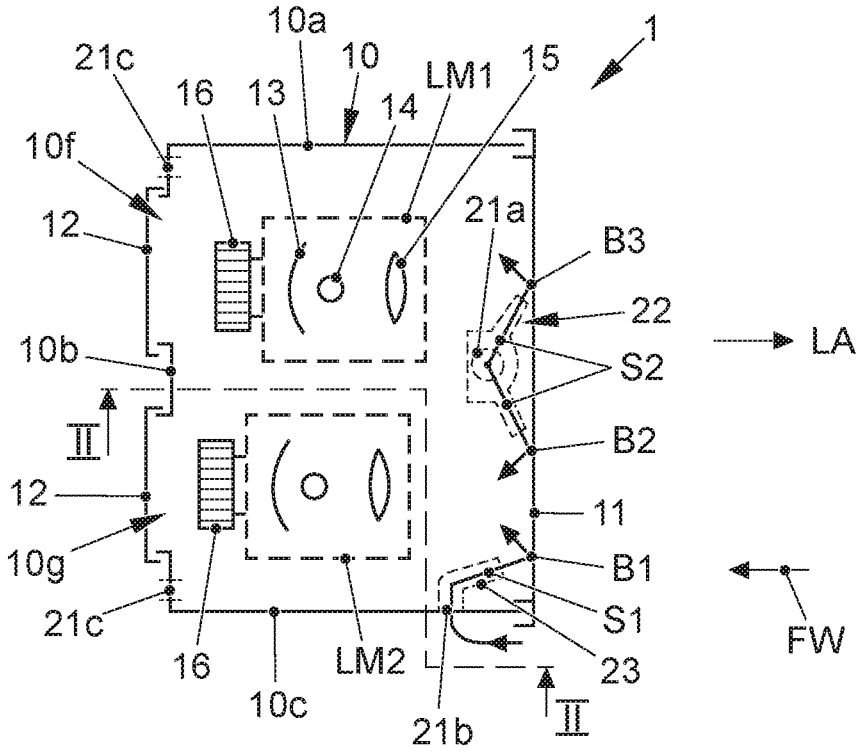
FIG. 1 shows a cross section through a first embodiment of a lighting device according to the invention.
Figure 2:
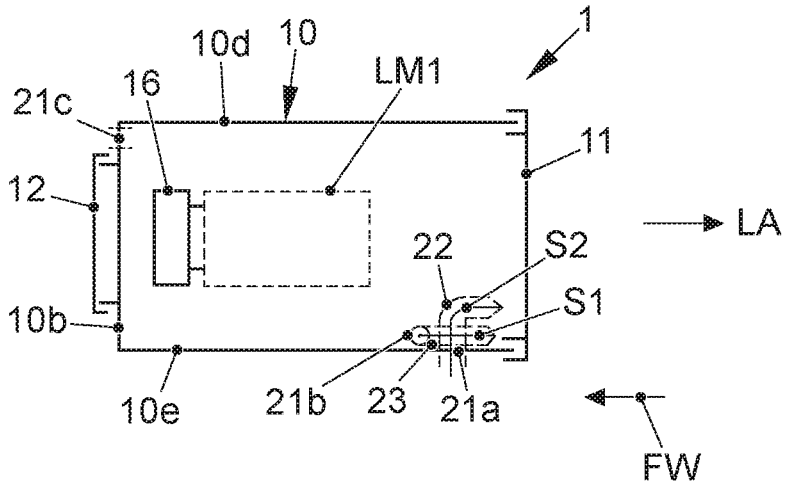
FIG. 2 shows the lighting device according to the sectional profile along the multi-segment line II-II from FIG. 1.

Referring now to the figures of the drawing in detail and first, particularly, to FIGS. 1 and 2 thereof, there is shown a lighting device 1 according to the invention. The lighting device 1 has a housing 10 in which two light modules LM1 and LM2 are accommodated.

Each of the light modules LM1 and LM2 is embodied as a projection module and has at least one light source 14, also referred to as lighting means 14, whose light beams (not illustrated) are reflected by a reflector 13 in the direction of a projection lens 15. The light source 14 can preferably be embodied as light-emitting diodes (LEDs) or as LED circuit boards. However, other types of light sources are conceivable. The light modules LM1 and LM2 can also be embodied as pivoting modules and can be moved by means of a suitable pivoting device (not illustrated) in such a way that beam width adjustment and/or a cornering light can be generated.

A heat sink 16 having cooling fins is connected in a thermally conductive fashion to each of the light modules LM1 and LM2.

The housing 10 has lateral walls 10*a* and 10*c*, a rear wall 10*b*, an upper wall 10*d* and a lower wall 10*e*.

In a light emission direction LA, which corresponds in the mounted state of the lighting device 1 to a conventional travel direction F of a motor vehicle K (cf. FIG. 11), the housing 10 is closed by means of a lens 11. The rear wall 10*b* has two access openings 10*f* and 10*g*, via which mounting operations or repair operations are possible. The access openings 10*f*, 10*g* are closed by covers 12.

From the figures it is also apparent that the lower wall 10*e*, which therefore forms the floor of the lighting device 1, is provided with a ventilation opening 21*a*, and the lateral wall 10*c* is provided with a ventilation opening 21*b* in the region near to the floor. In the region of the ventilation openings 21*a*, 21*b*, separate components 22 and 23 are connected to the walls 10*c* and 10*e*, respectively. The components 22 and 23 are embodied, in particular, as air-guiding elements and are latched to the walls 10*c*, 10*e*, which permit them to be mounted easily.

The components 22 and 23 are embodied in such a way that a slip stream FW penetrating the ventilation openings 21*a*, 21*b* passes into the components 22, 23, and is deflected in a flow S1 (component 23) or S2 (component 22) selectively to at least one specific partial region B1 or B2 and B3 of the lens 11.

The regions B1, B2 and B3 are intended to illustrate regions which can only be ventilated very inadequately with an air flow which is known in the prior art. However, with the illustrated selective ventilation from the slip stream, these regions can be ventilated very effectively.

Ventilation openings, through which air which penetrates the housing 10 can also escape again, are indicated by dashed lines with 21*c*.

Figure 3:
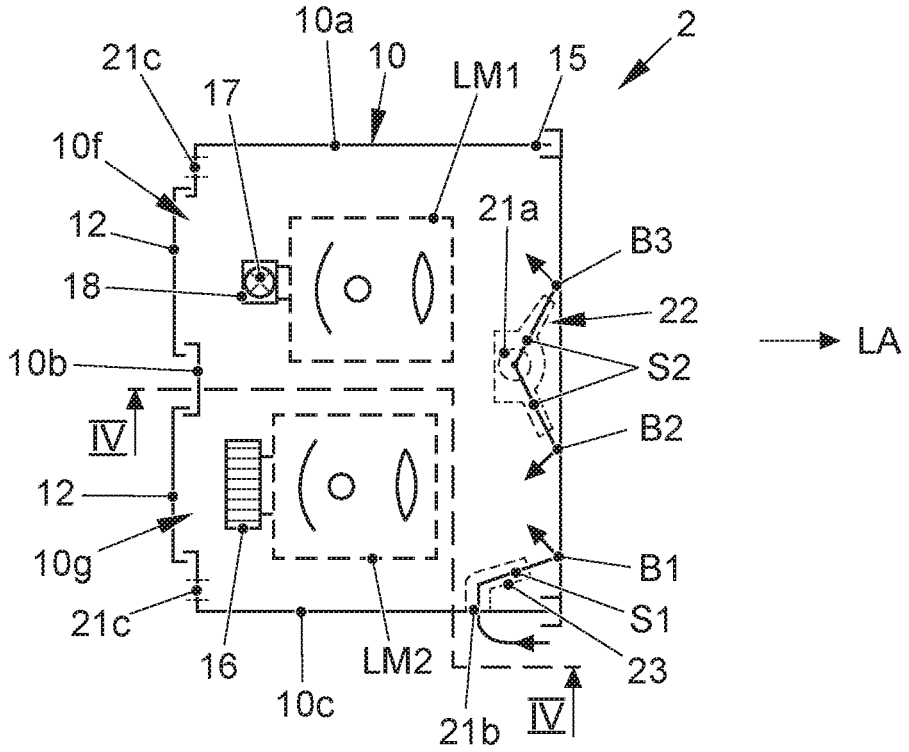
FIG. 3 shows a cross section through second embodiment of the lighting device according to the invention.
Figure 4:
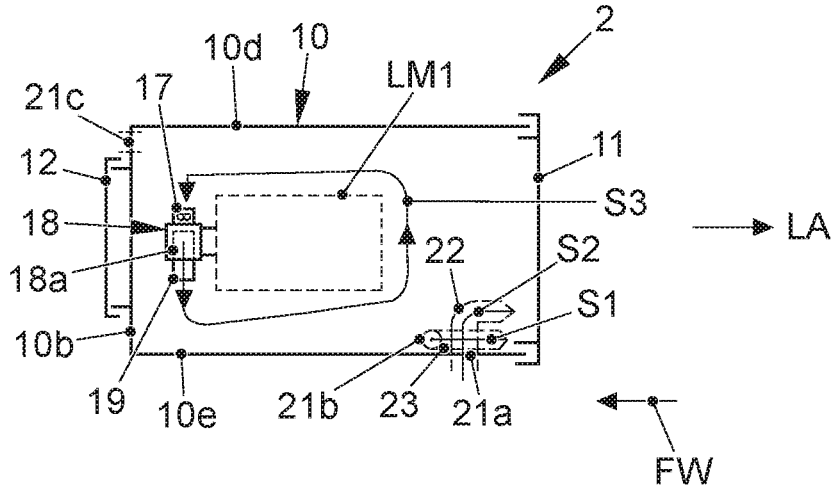
FIG. 4 shows the lighting device according to the sectional profile IV-IV from FIG. 3.

Referring to FIGS. 3 and 4, a second exemplary embodiment of a ventilation device 2 will now explained in which, in contrast to the ventilation device 1, there is an active ventilation device in the region of the rear wall 10*b*. The active ventilation device is composed of a heat sink 19 which is thermally coupled to the light module LM1 and above which a fan 17 is arranged. The fan 17 is positioned above the heat sink 19 by means of a mount 18. The mount 18 has walls 18*a* which enclose the heat sink 19 from the outside, at least for the most part. As a result, an air flow S3, which is generated by the fan 17, and which runs from top to bottom, can be guided through the heat sink 19 without appreciable losses.

As is apparent, the air flow S3 which is generated by the fan 17 produces a circuit which is directed downward in the region of the fan 17 and upward in the region of the lens 11. In particular, in this way heat which is generated by the lighting means 14, for example by LED circuit boards, is transported downward via the heat sink 19 by the fan 17. This increases the protection of the lighting means 14 against overheating and the safeguarding of the light performance. In addition, as a result warm air is moved through the relatively cool regions of the lighting device and can pick up moisture there (demisting). It is to be noted that the fan 17 is also operated when the motor vehicle K is stationary (cf. FIG. 11), with the positive effects as described above.

Figure 5:
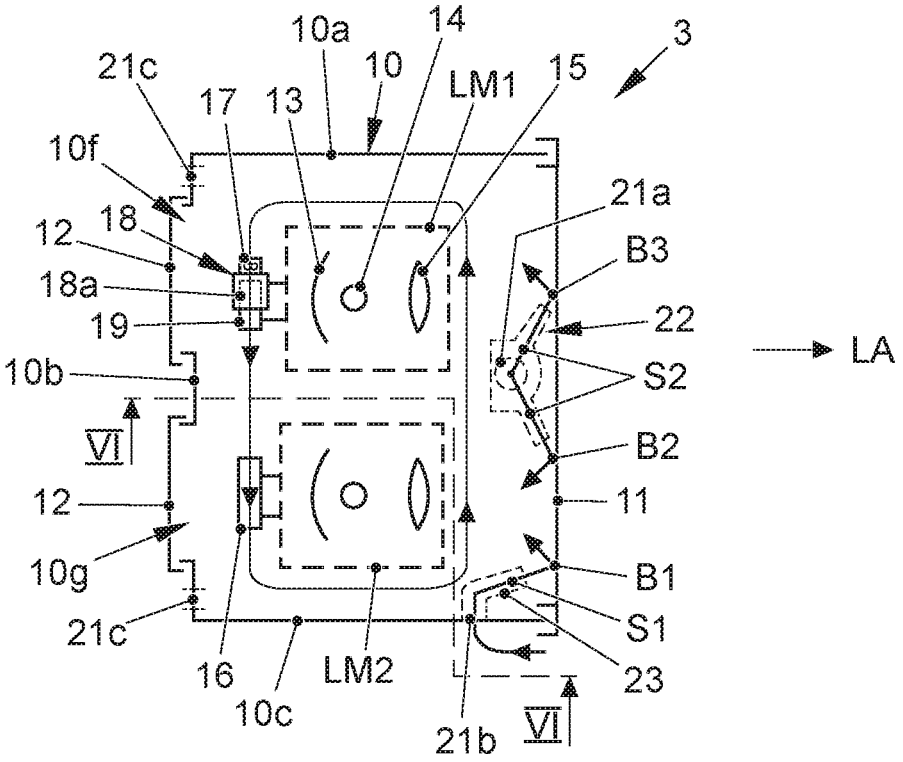
FIG. 5 shows a cross section through a third embodiment of the lighting device according to the invention.
Figure 6:
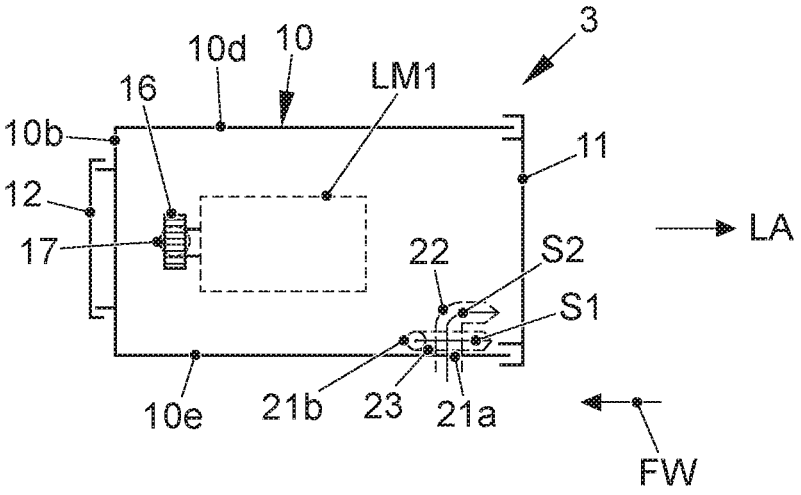
FIG. 6 shows an illustration of the lighting device according to the sectional profile VI-VI from FIG. 5.

A third exemplary embodiment of a lighting device 3 will now be described with reference to FIGS. 5 and 6. In contrast to the lighting device 2, the fan 17 is arranged here together with the mount 18 in such a way that the fan 17 generates a horizontal air flow S4 which runs transversely with respect to the light emission direction LA at least in the region of the fan 17.

This has the advantage that the air flow S4 which is generated by the fan 17 also flows directly through the heat sink 16 of the second light module LM2, which is not equipped with a fan, and therefore an effective dissipation of the heat generated by the lighting means 14 of all the light modules LM1/LM2 is achieved.

Figure 7B:
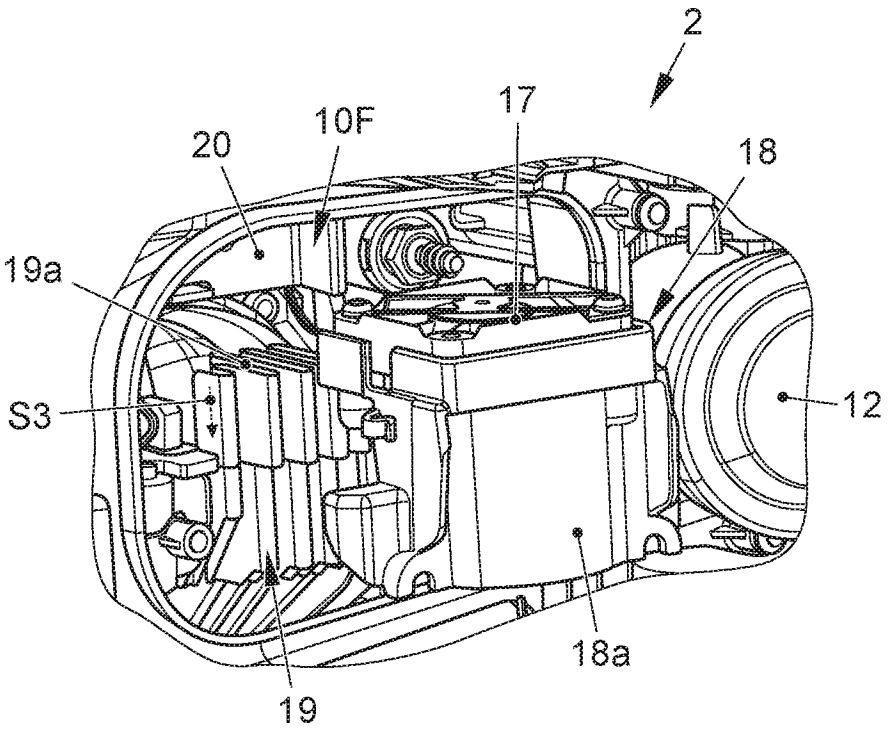
FIGS. 7A and 7B show perspective and detailed illustrations of the lighting device according to FIGS. 3 and 4, in the region of the fan.
Figure 7A:
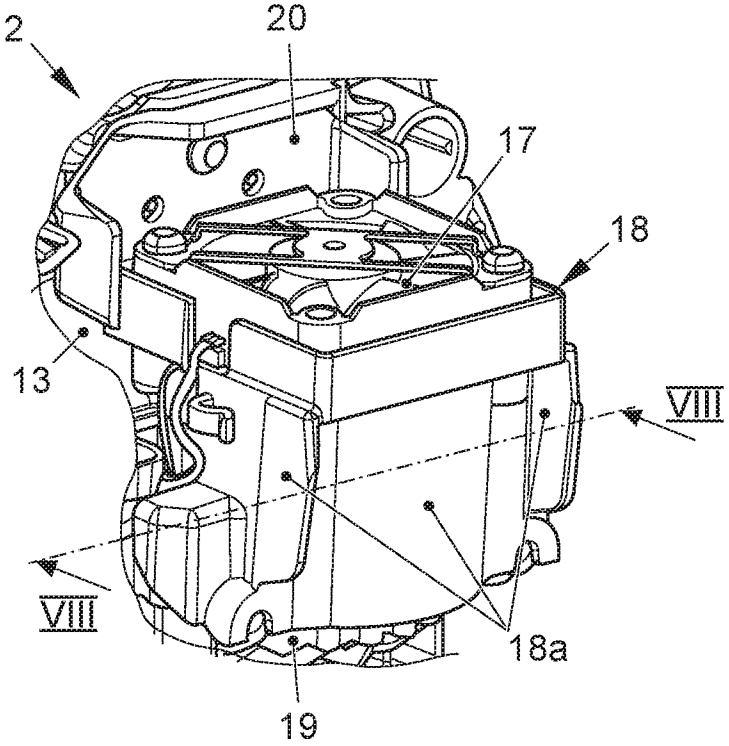

A view of a partial region of the lighting device 2 will now be considered once more with reference to FIGS. 7A and 7B. In said figures, the fan 17 can be seen together with the mount 18 in detail. Here, the cover 12 of the rear opening 10*f* was removed. The mount 18 itself is mounted on a mounting element 20 above the heat sink 19.

In specific terms, FIG. 7A shows the fan 17 in its installation position, and FIG. 7B shows it in a nonmounted position. It is apparent that the fan 17 is attached from above with the mount 18. In this context it projects somewhat into surrounding walls of the mount 18. In the downward direction, that is to say along or parallel to the air flow S3 which is generated, the mount 18 is lengthened by three walls 18*a* which are connected to one another in a materially joined fashion. In the mounted position, the heat sink 19 is surrounded by the walls 18*a* for the most part.

Figure 8:
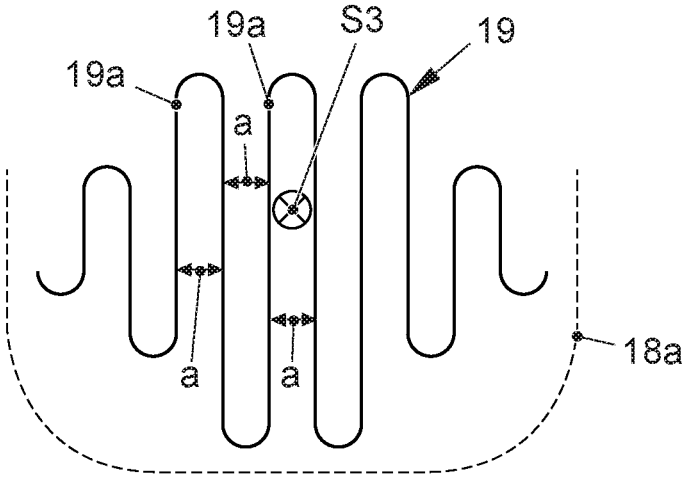
FIG. 8 shows a sectional illustration according to the sectional profile VIII-VIII from FIG. 7A.

In this way, the air flow S3 which is generated by the fan 17 can flow through the heat sink 19, in particular through clearance distances a between cooling fins 19*a*, without appreciable losses (cf. also FIG. 8).

As becomes apparent, in particular, from FIG. 8, the cooling fins 19*a* run in a meandering fashion in the horizontal cross section. As a result, an extremely good thermal efficiency level of the heat exchange can be achieved.

Figure 9:
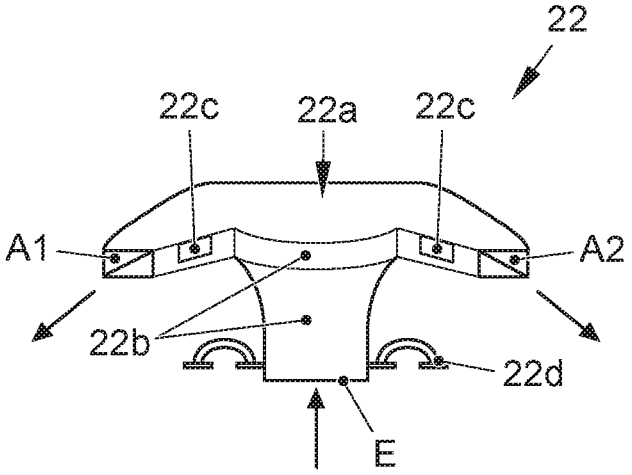
FIG. 9 shows an air-guiding component in isolation.

In FIG. 9, the component 22 is shown once more in isolation. It is apparent that the component 22 is composed of an upper part 22*a* and a lower part 22*b*. The lower part 22*a* and the upper part 22*b* are joined via latching means 22*c*. The component 22 can be latched to the housing 10 of a lighting device 1, 2, 3 in the region of the ventilation opening 21*a* using latching means 22*d*. The component 22 has an air inlet opening E and two air outlet openings A1 and A2, through which an entering air flow can be divided. There can also be more than two air outlet openings.

Figure 10:
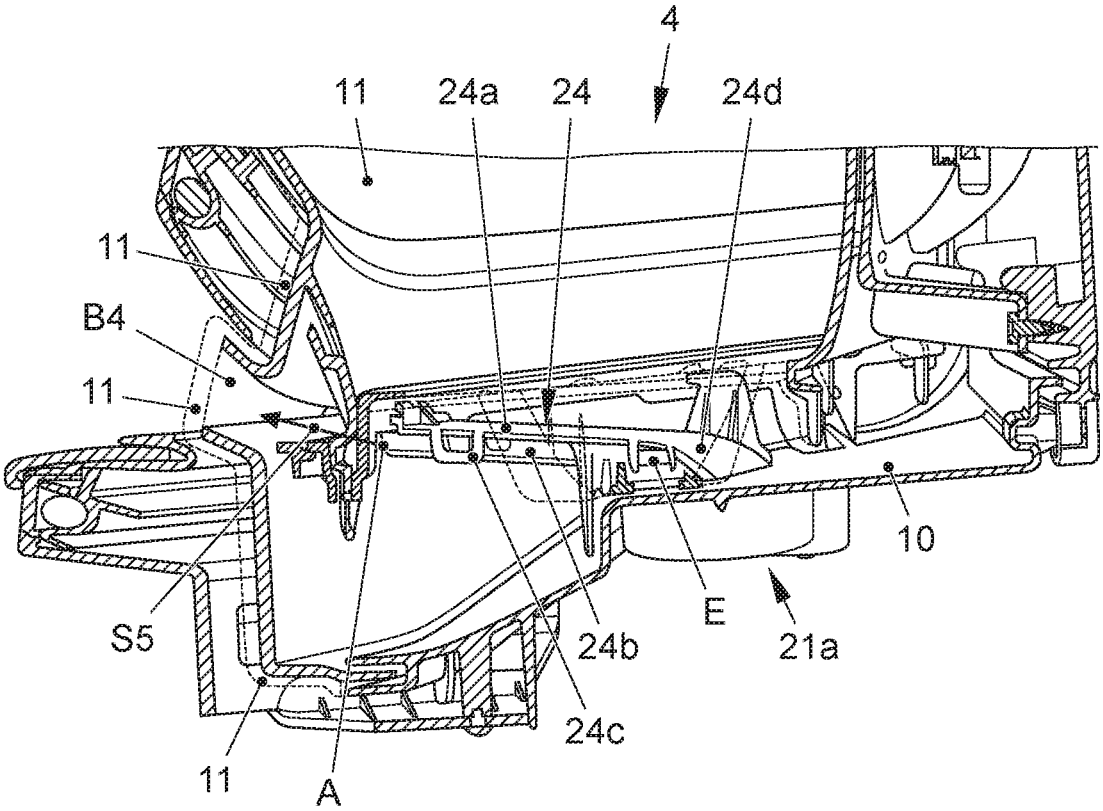
FIG. 10 shows a partial detail of a further embodiment of a lighting device in the region of an air-guiding component.

A partial detail of a further embodiment of a lighting device 4 can be seen in FIG. 10. Here, a separate component 24 is latched to the lower wall of a housing 10 in the region of a ventilation opening 21*a*. The component 24 also has an upper part 24*a* and a lower part 24*b*, which are connected to one another by latching means 24*c* and by which a ventilation duct is formed. An inlet opening E, which is approximately rectangular in cross section, is positioned above the ventilation opening 21*a*. Furthermore, the upper part 24*a* is lengthened with a canopy-like extension 24*d* above the inlet opening E. In this way, a slip stream FW which penetrates the ventilation opening 21*a* can pass particularly easily into the ventilation duct of the component 24, and an air flow S5 at an air outlet opening A can exit again selectively in the direction of a partial region B4 of a lens 11 which is difficult to access.

Figure 11:
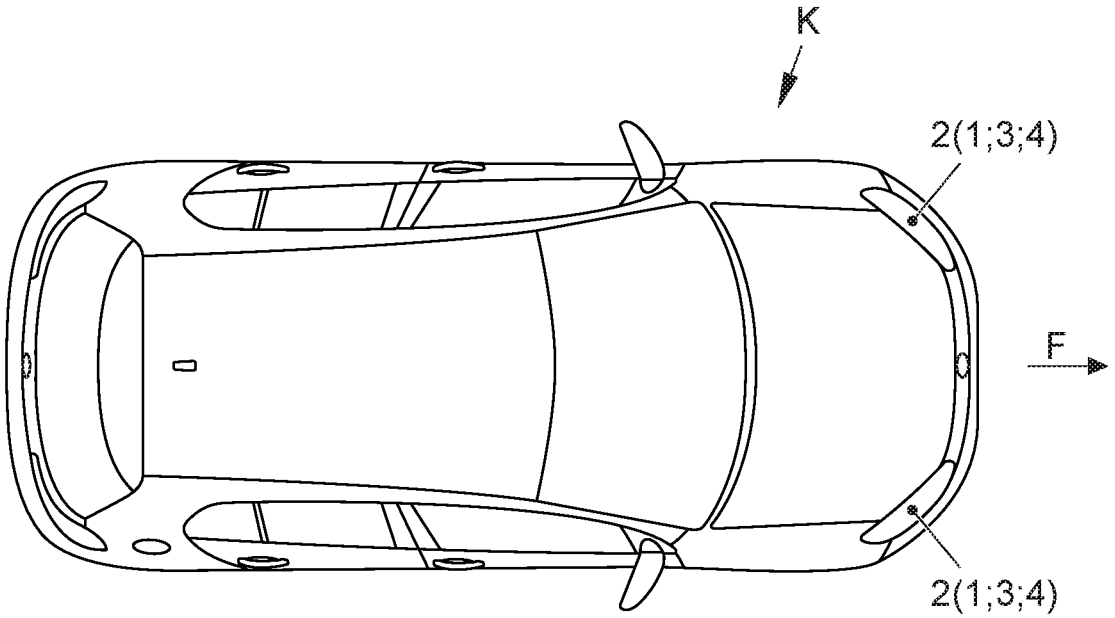
FIG. 11 shows a motor vehicle having lighting devices according to the invention.

Finally, FIG. 11 illustrates a motor vehicle K which is equipped with two lighting devices 2 according to the invention in the form of headlights. Instead of the lighting devices 2, it is, of course, also possible for the lighting devices 1, 3 or 4 to be mounted.

The following is a summary list of reference numerals and the corresponding structure used in the above description of the invention:

1 Lighting device
2 Lighting device
3 Lighting device
4 Lighting device
10 Housing
10*a* Lateral wall
10*b* Rear wall
10*c* Lateral wall
10*d* Upper wall
10*e* Lower wall
10*f* Access opening
10*g* Access opening
11 Lens
12 Cover
13 Reflector
14 Light source, lighting means
15 Projection lens
16 Heat sink
17 Fan
18 Mount
18*a* Wall
19 Heat sink
19*a* Cooling fins
20 Mounting element
21*a,b* Ventilation openings
21*c* Venting openings
22 Separate component
22*a* Upper part
22*b* Lower part
22*c, d* Latching means
23 Separate component
24 Separate component
24*a* Upper part
24*b* Lower part
24*c* Latching means
24*d* Canopy-like extension
a Distances
A, A1, A2 Air outlet openings
B1-B4 Partial regions of the lens
E Air inlet opening
F Travel direction
FW Slip stream
K Motor vehicle
LA Light emission direction
LM1, LM2 Light modules
S1-S5 Air flows

The invention claimed is:

1. A lighting device for a motor vehicle, the lighting device comprising:

a housing with an interior and a housing wall, said housing wall having a ventilation opening formed therein, and a lens of the lighting device;

a ventilation device for ventilating the interior of the lighting device, said ventilation device having at least one separate component connected to said housing wall in a vicinity of said ventilation opening, said separate component being configured to enable external air from outside to pass into the interior;

said component being an air-guiding element configured to selectively deflect a slip stream of air from the outside onto at least one specific partial region of said lens.

2. The lighting device according to claim 1, wherein said component is composed of at least two parts.

3. The lighting device according to claim 1, wherein said component is formed with one air inlet opening and at least two air outlet openings for dividing an air stream entering said component.

4. The lighting device according to claim 1, wherein said at least one separate component is arranged in a front region of a lower housing wall in close vicinity to said lens.

5. The lighting device according to claim 1, which comprises at least one fan in the interior of said lighting device for generating an air flow.

6. The lighting device according to claim 5, wherein said fan is oriented so as to generate a vertical air flow.

7. The lighting device according to claim 5, wherein said fan is oriented so as to generate a horizontal air flow running transversely with respect to a light emission direction or a travel direction of the motor vehicle.

8. The lighting device according to claim 5, which comprises a heat sink and wherein said fan is positioned to generate an air flow that is guided directly through a heat sink.

9. The lighting device according to claim 8, wherein said heat sink has, in cross section, cooling fins which run in a meandering fashion and have clearance distances through which the air flow generated by said fan flows.

10. The lighting device according to claim 8, which comprises a mount supporting said fan and three walls extending from said mount, said three walls being connected to one another in a materially joined fashion and extend along the flow direction of the air flow generated by said fan, and wherein said walls enclose said heat sink, at least for the most part.

11. A motor vehicle, comprising at least one lighting device, the lighting device including:

a housing with a housing wall and a lens defining an interior of the lighting device, said housing wall having a ventilation opening formed therein;

a light source disposed in said interior of said housing;

a ventilation device for ventilating the interior of the lighting device, said ventilation device having an air-guiding element being a separate component connected to said housing wall in a vicinity of said ventilation opening, said air guiding device being configured to enable external air from outside to pass into the interior and to selectively deflect a slip stream of air from the outside onto at least one specific partial region of said lens when the motor vehicle is moving.

12. A lighting device for a motor vehicle, the lighting device comprising:

a housing with a housing wall and a lens together defining an interior of the lighting device;

said housing wall having a ventilation opening formed therein;

a ventilation device for ventilating the interior of the lighting device, said ventilation device having an air-guiding element being a separate component connected to said housing wall in a vicinity of said ventilation opening, said air-guiding element being configured to enable external air from outside to pass into the interior and to selectively deflect a slip stream of air from the outside onto at least one specific partial region of said lens;

said air-guiding element having one air inlet opening and at least two air outlet openings for dividing the slip stream of air entering said component.

13. The lighting device according to claim 12, wherein said at least one separate component is arranged in a front region of a lower housing wall in close vicinity to said lens.

* * * * *